United States Patent [19]

Sawyer

[11] 4,359,928

[45] Nov. 23, 1982

[54] HIGH RATE OF FIRE REVOLVING BATTERY GUN

[75] Inventor: Quentan T. Sawyer, Milton, Vt.

[73] Assignee: General Electric Company, Burlington, Vt.

[21] Appl. No.: 230,559

[22] Filed: Feb. 2, 1981

[51] Int. Cl.[3] ..... F41D 7/04

[52] U.S. Cl. ..... 89/12; 89/33 SF

[58] Field of Search ..... 89/12, 33 SF

[56] References Cited

U.S. PATENT DOCUMENTS

| | | | |
|---|---|---|---|
| 125,563 | 4/1872 | Gatling | 89/12 |
| 3,380,341 | 4/1968 | Chiabrandy | 89/12 |
| 3,611,871 | 10/1971 | Kirkpatrick et al. | 89/127 |
| 3,738,221 | 6/1973 | Tan et al. | 89/12 |
| 4,046,056 | 9/1977 | Carrie | 89/12 |
| 4,274,325 | 6/1981 | Snyder et al. | 89/12 |

*Primary Examiner*—David H. Brown

*Attorney, Agent, or Firm*—Bailin L. Kuch

[57] ABSTRACT

A feature of this invention is the provision of a Gatling type gun having a firing/safing cam assembly having three dispositions: one permitting firing in one direction of rotation; another permitting firing in the other direction of rotation; and yet another precluding firing in either direction of rotation of the rotor, all by means of two independently operated cam elements and a continuum element operated as a function of the respective dispositions of said cam elements.

5 Claims, 7 Drawing Figures

HIGH RATE OF FIRE REVOLVING BATTERY GUN

BACKGROUND OF THE INVENTION

1. Field of the Invention

This invention relates to Gatling type guns, and more particularly to such a gun which can fire in both directions of rotation of its gun barrel rotor.

2. Prior Art

In U.S. Pat. No. 125,563 issued Apr. 9, 1872 to R. J. Gatling, there is shown the classic modern revolving battery gun. A stationary housing encloses and supports a rotor assembly which has a plurality of gun barrels, and a like plurality of gun bolts. Each bolt has its own firing pin and mainspring. As the rotor turns in an invariable direction, each bolt is traversed longitudinally by a stationary elliptical cam track in the housing. As the bolt is traversed forwardly, its firing pin is captured to the rear by a stationary cam track in the housing, compressing its mainspring until the bolt and the barrel reach the firing position, at which position the stationary cam track releases or sears the firing pin.

More modern Gatling type guns are shown by R. E. Chiabrandy in U.S. Pat. No. 3,380,341, issued Apr. 30, 1968; R. G. Kirkpatrick et al. in U.S. Pat. No. 3,611,871, issued Oct. 12, 1971, and R. M. Tan et al. in U.S. Pat. No. 3,738,221, issued June 12, 1973. In each of these guns the rotor turns in an invariable direction.

In the GAU-8 gun as carried by the A10 aircraft, the rotor turns in one direction to fire rounds, and turns in the opposite direction to clear unfired rounds back into the supply conveyor. A firing/safing cam which is adapted for use in the GAU-8 gun is shown by R. R. Snyder et al. in U.S. Ser. No. 058,359, filed July 17, 1979 now U.S. Pat. No. 4,274,325.

In U.S. Ser. No. 230,250 filed Feb. 2, 1981 D. P. Tassie shows a gun which may be driven and fired in both directions of rotation. Tassie provides a firing/safing cam having three dispositions: one permitting firing in one direction of rotation; another permitting firing in the other direction of rotation; and yet another safing against firing in either direction of rotation. These dispositions are achieved by means of a pivotal element which is controlled by two wedging elements.

SUMMARY OF THE INVENTION

It is an object of this invention to provide an improved firing/safing cam for a Gatling type gun which may be driven and fired in both directions of rotation.

A feature of this invention is the provision of a Gatling type gun having a firing/safing cam assembly having three dispositions: one permitting firing in one direction of rotation; another permitting firing in the other direction of rotation; and yet another precluding firing in either direction of rotation of the rotor, all by means of two independently operated cam elements and a continuum element operated as a function of the respective dispositions of said cam elements.

DESCRIPTION OF THE DRAWINGS

These and other objects, features, and advantages of the invention will be apparent from the following specification thereof taken in conjunction with the accompanying drawing in which.

DESCRIPTION OF THE PREFERRED EMBODIMENT

Figure 1:
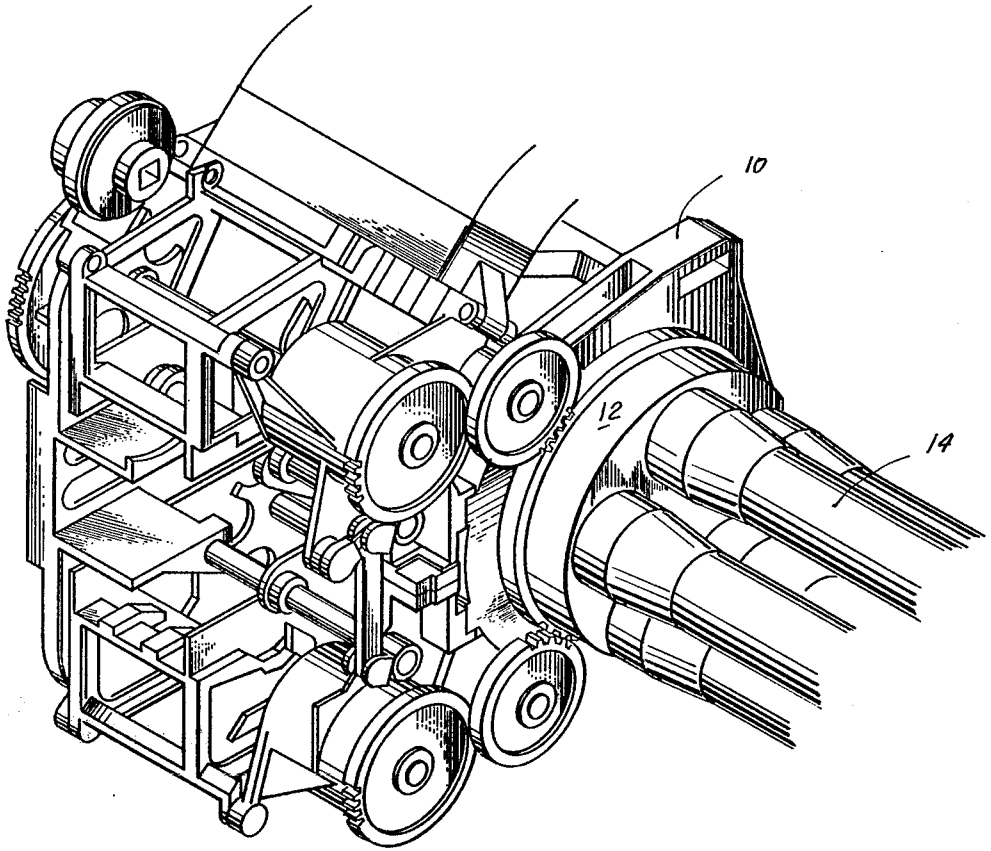
FIG. 1 is a perspective view of a gun embodying this invention.
Figure 3:
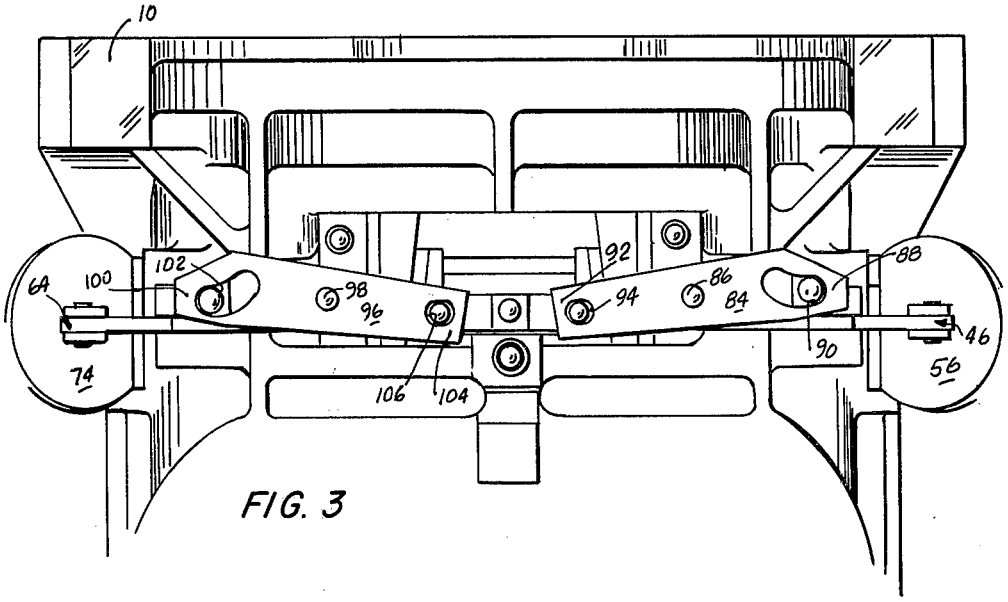
FIG. 3 is a top view of the assembly of FIG. 2.

The gun shown in FIG. 1 is of the general type shown by R. G. Kirkpatrick et al. in U.S. Ser. No. 137,704, filed Apr. 7, 1980 now U.S. Pat. No. 4,342,253. It includes a dual feeder as shown by D. P. Tassie in U.S. Ser. No. 230,564 filed Feb. 2, 1981. The gun may be driven in both directions by suitable means, such as the hydraulic system utilized with the GAU-8/A gun in the A10 aircraft, or the system shown by G. W. Carrie in U.S. Pat. No. 4,046,056 issued Sept. 6, 1977.

Alternatively, the electrical system shown by J. A. Kleptz in U.S. Ser. No. 213,243 filed Dec. 14, 1980 may be utilized. Conventionally, such a drive is applied to a ring gear fixed to the gun rotor. In these systems the gun is driven in one direction to fire and in the other direction to clear. The changes in the control system to drive and fire in either direction are thought to be readily apparent.

These disclosures may be referred to for structure not shown or discussed herein.

The gun includes a housing 10 in which is journaled a rotor 12 having a plurality of gun barrels 14 and a like plurality of gun bolts 16, here shown as five in number.

Each gun bolt is disposed on tracks fixed to the rotor. Each bolt 16 has a roller which rides in a helical cam track in the housing 10, so that as the rotor rotates about the gun longitudinal axis, each gun bolt is traversed fore and aft on its tracks. Each gun bolt has a firing pin with a respective mainspring. Each firing pin has a respective cocking pin 22 standing up through a slot in the body of the gun bolt.

The safing and firing mechanism is fixed in the housing in a transversely extending slot therein.

The safing and firing mechanism includes a main frame 30 which is disposed in the slot of the housing and fixed by three bolts passing through bores in the frame and into tapped holes in the housing.

The main frame 30 extends through the slot and has a cam portion including a right cam surface 34, a left cam surface 36, and a central cutout 38 having a backwall 40, a right sidewall 42 and a left sidewall 44.

Figure 2:
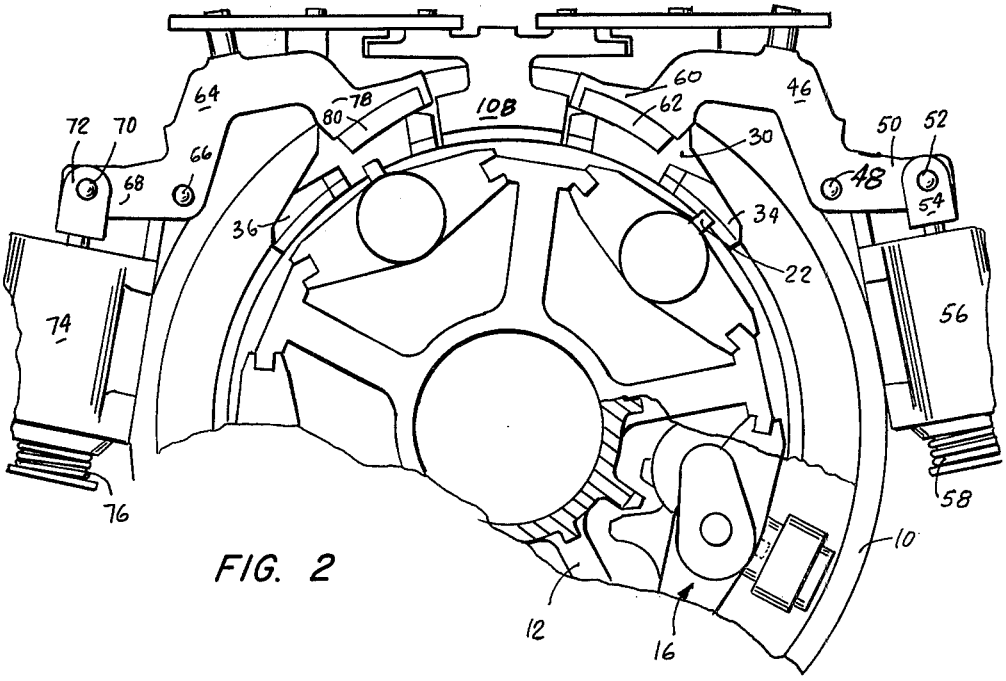
FIG. 2 is a transverse cross-section of the gun of FIG. 1 showing the firing/safing cam assembly in it safe disposition.
Figure 5:
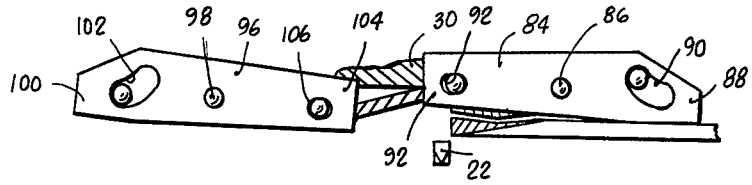
FIG. 5 is a top view of the assembly of FIG. 4.
Figure 4:
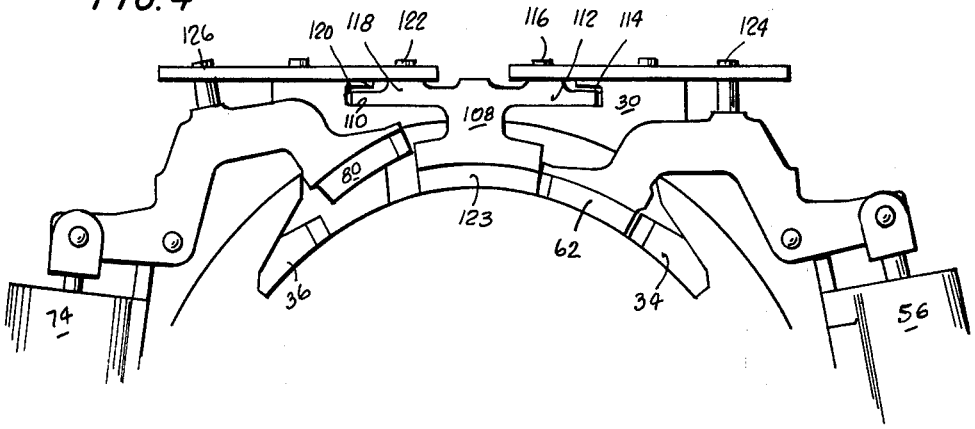
FIG. 4 is a detail of a FIG. 2 showing the firing/safing cam assembly in its counterclockwise firing disposition.
Figure 6:
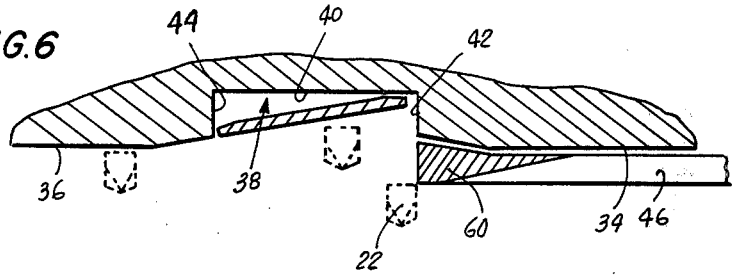
FIG. 6 is a top view in cross-section of a detail of the assembly of FIG. 4.
Figure 7:
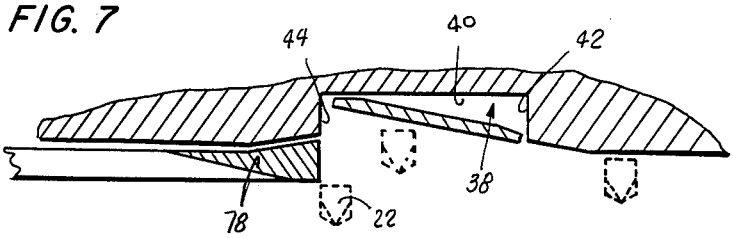
FIG. 7 is a top view in cross-section similar to FIG. 6 but showing the firing/safing cam assembly in its clockwise firing disposition.

A right crank arm 46 is pivotally mounted to the main frame 30 by a pin 48 and has a tail portion 50 which is connected by a pin 52 to an actuator 54 of a solenoid 56. The actuator is biased by a helical compression spring 58. The right crank arm has a head portion 60 which has a cam surface 62. The spring of the solenoid normally biases the crank arm in the up disposition shown in FIG. 2 so that the head portion 60 is spaced up and away from the cam portion. When the solenoid 56 is energized the crank arm is forced into the down disposition shown in FIG. 4 so that the cam surface 62 is in annular alignment with the cam surface 34.

A left crank arm 64 is pivotally mounted to the main frame 30 by a pin 66 and has a tail portion 68 which is connected by a pin 70 to an actuator 72 of a solenoid 74. The actuator is biased by a helical compression spring 76. The left crank arm has a head portion 78 which has a cam surface 80. The spring of the solenoid normally biases the crank arm in the up position so that the head portion 78 is spaced up and away from the cam portion 36. When the solenoid is energized the crank arm is forced into the down disposition so that the cam surface 80 is in annular alignment with the cam surface 36.

A right lever 84 is pivotally mounted to the main frame 30 by a pin 86 and has right hand portion 88 with a right cam slot 90 and a left hand portion 92 with a left cam slot 94.

A left lever 96 is pivotally mounted to the main frame 30 by a pin 98 and has a left hand portion 100 with a left cam slot 102 and a right hand portion 104 with a right cam slot 106.

A safing gate 108 is disposed in part in a cutout 110 in the main frame 30. The gate has an upper portion having a right arm 112 which slides in a groove 114 and has a cam follower 116 which is disposed in the cam slot 94 of the right lever 84 and a left arm 118 which slides in a groove 120 and has a cam follower 122 which is disposed in the cam slot 106. The gate has a lower portion with a cam surface 123.

The right crank arm 46 has a cam driver 124 disposed in the cam slot 90 of the right lever 84, which serves to oscillate the right lever about its pivot 86 as the arm oscillates about its pivot 48.

The left crank arm 64 has a cam driver 126 disposed in the cam slot 102 of the left lever 96, which serves to oscillate the left lever about its pivot 98 as the arm oscillates about its pivot 66.

When the right solenoid 56 is de-energized, the spring 58 biases the crank arm clockwise with the cam surface 62 up and out of annular alignment with the cam surface 34. The cam driver 124 swings the right lever counterclockwise which carries with it the right hand portion 112 of the safing gate 108 so that the right hand portion of the cam surface 123 is spaced along the longitudinal axis of the gun away from the backwall 40 of the cutout 38 and is transversely aligned with the cam surface 34.

When the left solenoid 74 is de-energized, the spring 76 biases the crank arm counterclockwise with the cam surface 80 up and out of annular alignment with the cam surface 36. The cam driver 126 swings the left lever 96 clockwise which carries with it the left hand portion 118 of the safing gate 108 so that the left hand portion of the cam surface 123 is spaced along the longitudinal axis of the gun away from the backwall 40 of the cutout 38 and is transversely aligned with the cam surface 36.

Thus, when both solenoids 56 and 74 are de-energized, both cam surfaces 62 and 80 are up and away and the cam surface 123 is in transverse and annular alignment with the cam surfaces 34 and 36 and provides a continuum therebetween. This is the safe disposition of the assembly. When the rotor turns counterclockwise, each gun bolt, in sequence, is cammed progressively forward and its cocking pin 22 rides onto the cam surface 34 and progressively compresses the mainspring. However, the cocking pin continues to ride across on the cam surface 123 and then onto the cam surface 36. As the rotor continues counterclockwise, the gun bolt is cammed progressively rearward and its cocking pin 22 progressively releases the mainspring. When the cocking pin leaves the cam surface 36, the mainspring has been fully released, without firing. Similarly, when the rotor turns clockwise, the cocking pin 22 of each gun bolt rides onto the cam surface 36, progressively compresses its mainspring, rides across the cam surface 123 and then onto the cam surface 34 and progressively releases its mainspring, without firing.

When the right solenoid 56 is energized, and the left solenoid 74 is de-energized, the cam surface 62 is down and in annular alignment with the cam surface 34, while the cam surface 80 is up and away from the cam surface 36. Furthermore, the right hand portion of the cam surface 123 is adjacent the backwall 40, exposing the right wall 42 of the cutout 38, while the left hand portion of the cam surface 123 is spaced from the backwall 40 and is transverse and annular alignment with the cam surface 36. This is the counterclockwise firing disposition of the assembly. When the rotor turns counterclockwise, each gun bolt, in sequence, is cammed progressively forward and its cocking pin 22 rides onto the cam surface 34 and progressively compresses the mainspring. As the rotor continues counterclockwise, the cocking pin rides onto the cam surface 62 and further progressively compresses the mainspring until the cocking pin rides off the cam surface 62 and falls into the cutout 38, thereby firing the firing pin under the released compression of the mainspring. The cocking pin falls until it reaches the right hand portion of the cam surface 123 and then rides along the cam surface 123 until it rides off the left hand portion of the cam surface 123 onto the cam surface 36, during which travel it has withdrawn the firing pin and again progressively compresses the mainspring. As the rotor continues counterclockwise, the gun bolt is cammed progressively rearward and its cocking pin 22 progressively releases the mainspring. Should the gun have a reverse clearing mode of operation, then, while the gun is momentarily halted before turning in the reverse direction, the solenoid 56 is deenergized. This causes the cam surface 62 to move up and away, and the right hand portion of the cam surface 123 to be moved into transverse and annular alignment with the cam surface 34. The assembly is now in its safe disposition, as previously described. If a cocking pin 22 is lying on the cam surface 123 at this time, it will merely move along the axial direction of the gun with the right hand portion of the cam surface 123, compressing the mainspring. If a cocking pin 22 is lying on the cam surface 62 at this time, it will fall off the cam surface 62 onto the cam surface 34, which will not release the firing pin far enough for firing.

When the left solenoid 74 is energized, and the right solenoid 56 is de-energized, the situation is the mirror image of that previously described. This is the clockwise firing disposition of the assembly.

I claim:

1. A Gatling type gun comprising:

a housing having a longitudinal axis;

a rotor journaled for clockwise and counterclockwise rotation about said longitudinal axis;

a gun bolt carried by said rotor and having a firing pin and a cocking pin coupled thereto;

firing and safing cam means coupled to said housing and having:

a first disposition for causing said cocking pin to cock and to fire said firing pin during clockwise rotation of said rotor, a second disposition for causing said cocking pin to cock and to fire said firing pin during counterclockwise rotation of said rotor, and a third disposition for precluding said cocking pin from firing said firing pin during rotation of said rotor, said cam means including:

two independently operated cam elements and a continuum cam element and control means to operate said continuum element as a function of the respective dispositions of said two cam elements.

2. A gun according to claim 1 wherein:

said firing and safing cam means includes a first cam surface for initially engaging said cocking pin as said rotor turns clockwise.

a second cam surface for initially engaging said cocking pin as said rotor turns counterclockwise, said two independently operated cam elements and said continuum cam element in combination provide any one of an initial drop from said first cam surface and a subsequent progressive rise from said drop to said second cam surface in the clockwise direction, an initial drop from said second cam surface and a subsequent progressive rise from said drop to said first cam surface in the counterclockwise direction, and a continuum between said first and second cam surfaces.

3. A gun according to claim 2 further including:

a first fixed cam surface for initially engaging said cocking pin as said rotor turns clockwise, a second fixed cam surface for initially engaging said cocking pin as said rotor turns counterclockwise, said two independently operated cam elements include:

a first arm having a first distal cam surface and having a first disposition whereat said first distal cam surface is spaced away from said first fixed cam surface and a second disposition whereat said first distal cam surface overlies and progressively adds to said first fixed cam surface as said rotor turns clockwise, a second arm having a second distal cam surface and having a first disposition whereat said second distal cam surface is spaced away from said second fixed cam surface and a second disposition whereat said second distal cam surface overlies and progressively adds to said second fixed cam as said rotor turns counterclockwise.

4. A gun according to claim 3 wherein:

said continuum cam element includes:

a shiftable element having a cam surface extending between a first side edge and a second side edge, and said control means includes:

means for causing said shiftable element to assume any one of the following dispositions:

a first disposition whereat said first side edge is spaced from said first distal cam surface and said second side edge is closely adjacent to said second fixed cam surface, a second disposition whereat said second side edge is spaced from said second distal cam surface and said first side edge is closely adjacent to said first fixed cam surface, and a third disposition whereat said first side edge is closely adjacent to said first fixed cam surface and said second side edge is closely adjacent to said second fixed cam surface.

5. A gun according to claim 4 wherein:

said control means includes a first coupling means coupled to and between said first arm and said shiftable element and a second coupling means coupled to and between said second arm and said shiftable element, and has a mode of operation such that:

when said first arm is in its first disposition and said second arm is in its second disposition said shiftable element is in its second disposition, when said first arm is in its second disposition and said second arm is in its first disposition said shiftable element is in its first disposition, and when said first and second arms are both in their respective first dispositions, said shiftable element is in its third disposition.

* * * * *